US009375755B2

(12) United States Patent
Karl

(10) Patent No.: US 9,375,755 B2
(45) Date of Patent: Jun. 28, 2016

(54) LATERAL SEALING FOR A FLIP-FLOW SCREEN

(71) Applicant: IFE Aufbereitungstechnik GmbH, Waidhofen/Ybbs (AT)

(72) Inventor: Christian Karl, Gaming (AT)

(73) Assignee: IFE Aufbereitungstechnik GmbH (AT)

( * ) Notice: Subject to any disclaimer, the term of this patent is extended or adjusted under 35 U.S.C. 154(b) by 0 days.

(21) Appl. No.: 14/676,145

(22) Filed: Apr. 1, 2015

(65) Prior Publication Data

US 2015/0283582 A1 Oct. 8, 2015

(30) Foreign Application Priority Data

Apr. 3, 2014 (EP) ..... 14163395

(51) Int. Cl.
*B07B 1/46* (2006.01)
*B07B 1/48* (2006.01)

(52) U.S. Cl.
CPC .. *B07B 1/46* (2013.01); *B07B 1/485* (2013.01)

(58) Field of Classification Search
CPC ..... B07B 1/46; B07B 1/48; B07B 2201/02
USPC ..... 209/405, 408, 412
See application file for complete search history.

(56) References Cited

U.S. PATENT DOCUMENTS 5,062,949 A 11/1991 Hausmann
5,363,970 A 11/1994 Freissle
6,283,303 B1 * 9/2001 Lane ..... B07B 1/46 209/399
7,150,358 B2 * 12/2006 Carr ..... B07B 1/46 209/399
7,168,569 B2 * 1/2007 Peresan ..... B01D 33/0384 175/66
7,344,032 B2 * 3/2008 LaVeine ..... B07B 1/46 209/310
8,757,392 B2 * 6/2014 LaVeine ..... B07B 1/485 209/319
9,144,825 B2 * 9/2015 Wojciechowski ..... B07B 1/4645
2005/0274653 A1 * 12/2005 LaVeine ..... B07B 1/28 209/310
2011/0198269 A1 * 8/2011 Young ..... B07B 1/46 209/365.1

FOREIGN PATENT DOCUMENTS

AT 8742 U1 12/2006
WO 2005123278 A2 12/2005

* cited by examiner

*Primary Examiner* — Joseph C Rodriguez
(74) *Attorney, Agent, or Firm* — Kolisch Hartwell, P.C.

(57) ABSTRACT

Flip-flow screens having crossbars which extend transversely to the screening direction, carry a screen liner and are mounted alternately fixedly and movably with respect to a screen frame, where the screen liner is mounted on liner carriers which are curved upward in their lateral edge regions. In order to improve lateral sealing, provision is made for all the liner carriers to be fastened, preferably screwed, by their end regions to the screen frame. The lateral edge regions are preferably curved by 80-90°, and the liner carriers of the movable crossmembers may have in their curved portion a cross section which is tapered in relation to the rectilinear portion and/or which may consist of a softer material.

15 Claims, 4 Drawing Sheets

LATERAL SEALING FOR A FLIP-FLOW SCREEN

Figure 1:
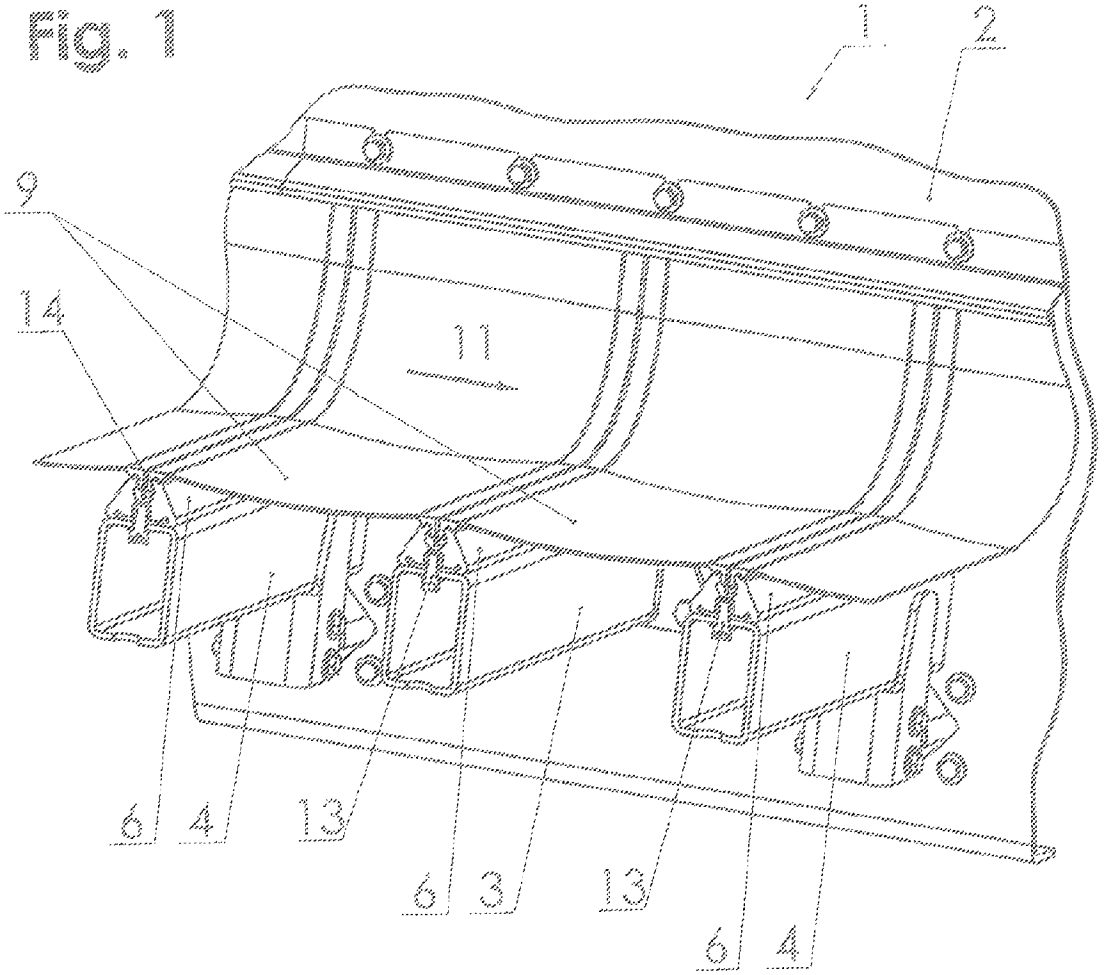

The invention relates to a flip-flow screen in accordance with the preamble of claim 1 and WO 2005/123 278.

This document proposes a solution for the frequently addressed, but still not finally satisfactorily resolved problem of laterally sealing a screen liner of a flip-flow screen with respect to the two lateral longitudinal walls of the screen frame. Flip-flow screens are provided with bars extending transversely to the screening direction and carrying, usually via liner carriers, a screen liner. The crossbars are alternately fastened nonmovably to a screen frame, which should be regarded as fixed, or mounted movably with respect to said frame. There is a wide variety of movable mounting; this also includes embodiments in which the screen box itself is moved, with the result that the fixed crossbars are mounted specifically only with respect to the moving screen box, but not with respect to the surroundings. The crossbars referred to usually and also hereinbelow as movable can be mounted and moved in a wide variety of ways; this does not play an essential role for the present invention.

The document mentioned at the beginning proposes that the liner carriers provided in the usual way on the crossbars, and thus the screen liner, be curved up in the lateral region of the screen by about 45° in order to provide a trough formed by the screen liner. The liner and each liner carrier ends at a distance from the lateral longitudinal wall of the frame. In the region of the movable screen bars, the liner carriers are supported only on the crossbar and end at a distance from the lateral longitudinal wall of the frame. Provided over the entire length of the lateral edge of the screen liner formed in this way is a lip which is fastened to the lateral longitudinal wall, covers the narrow, open edge region present between the screen liner and lateral longitudinal wall and bears elastically and flat against the edge region of the screen liner.

This construction constitutes an improvement in comparison to still earlier solution proposals in which a roof tile-like overlapping of adjacent screen liner parts was provided and also by comparison with other proposals, but still suffers both from the problem of severe wear in the region of the covering lip and also from the problem of the narrowing of the width of the screen as a result of the construction, which bears the covering lip, projecting toward the center of the screen, and in addition from the problem of the further reduced effective screening surface as a result of the 45° deflection of the screen liner which occurs with a large radius, and finally from the problem of the still present lack of sealing between the constantly fixed covering lip and the screen mat which vibrates in large regions of the screen length.

DE 44 22 994 discloses a flip-flow screen whose liner carriers and whose screen liner are bent upward in the edge region by 90° with a small radius, but remain at a distance from the side wall of the frame. The gap thus remaining is covered in a contact-free manner. This cover is of no use against dust and fines, and the unavoidable abrasion results in damage and premature wear in this region.

AT 008 742 U discloses a flip-flow screen with a fine screen mat, FIG. 1 of which, by contrast with all other figures and without explanation, illustrates laterally bent-up screen elements which apparently bear against the side wall of the frame and the upper edge of which is shielded upwardly by a strip fastened to the side wall. Such a seal is afflicted with the aforementioned disadvantages even when fine material is concerned, and is completely unsuitable for coarser material.

U.S. Pat. No. 5,363,970 also discloses a screen which is formed of individual elements but which is not a flip-flow screen. It is constructed in a modular manner both in the screening direction and transversely thereto such that it is also sealed at the abutment points. The actual edge of the screen as a whole is not illustrated, and there is no mention of an edge seal.

It is an aim of the invention to avoid the aforementioned disadvantages and to specify a lateral seal which does not have these problems.

According to the invention, these aims are achieved by the measures indicated in the characterizing part of claim 1; in other words, all the liner carriers are immovably or fixedly fastened, preferably screwed, by their end regions to the lateral longitudinal walls of the screen frame; rubbing or sliding of the screen liner on the side cheeks, as in some embodiments of the prior art, does thus not occur. The deformations occurring during operation in the liner carriers of the movable crossbars are elastically absorbed by them.

In one embodiment of the liner carriers, provision is made for them to be bent up at least by 45°, preferably by 80° and particularly preferably by 90°. By reducing the deflection, and with the same screen width, a widening of the planar screening surface is achieved, even if the articulation of the ends of the liner carriers on the screen frame become more complex.

In a region of their curved portion, which is preferably both at a distance from the free end and at a distance from the rectilinear (planar) portion, the liner carriers mounted on movable crossmembers are advantageously tapered in their cross section and/or consist of a softer material such that they are flexurally softer than in the other portions, with the result that the elastic deformation occurs in a concentrated manner in this region. It thus easier to overcome the vibrational loading, and the introduction of forces originating therefrom into the cheeks of the screen frame is reduced.

The screen liner is particularly preferably connected over the entire length to the lateral cheek of the screen frame and covered, preferably fixedly clamped, by a covering strip in the upper end region. Complete sealing is thus achieved.

Figure 2:
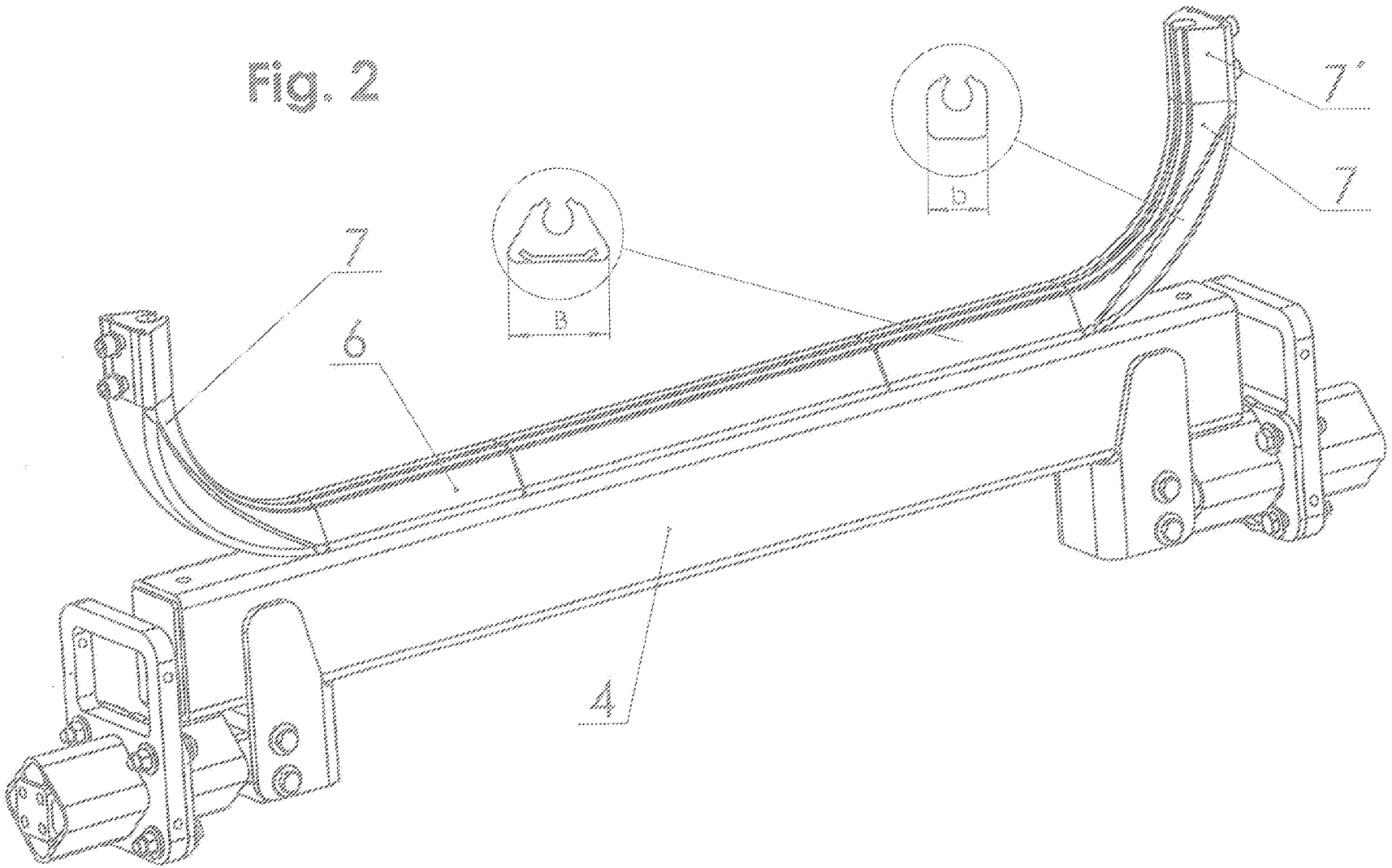
Figure 3:
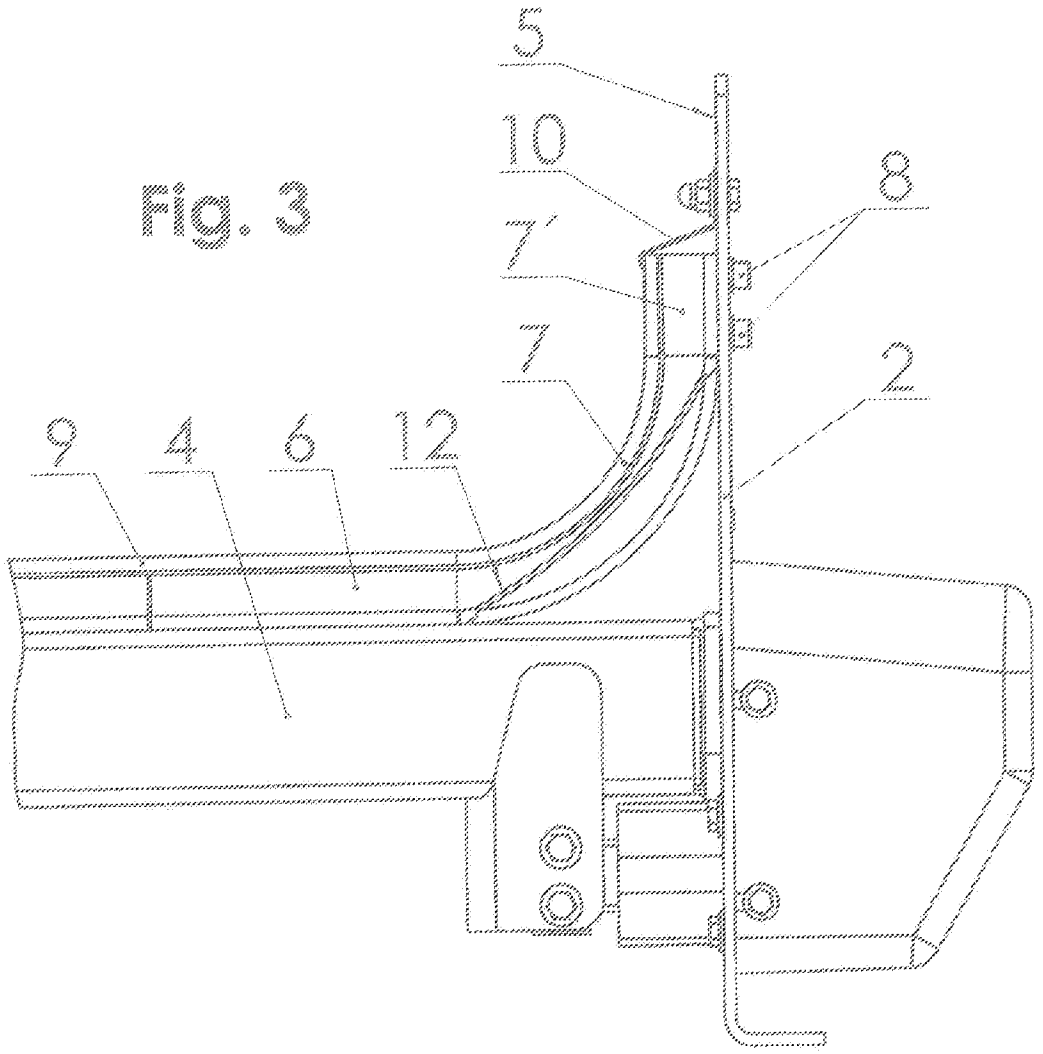
Figure 4:
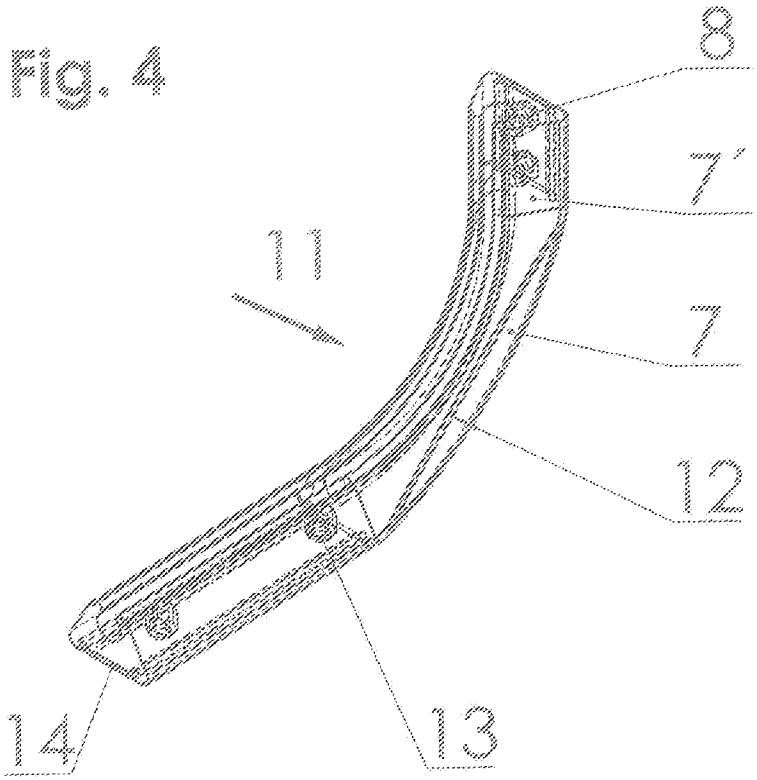

The invention will be explained in more detail below with reference to the drawing, in which FIG. 1 shows a screen equipped according to the invention in part, in a perspective view, FIG. 2 shows a movable crossbar with a liner carrier formed according to the invention, in a perspective view, FIG. 3 shows a detail of FIG. 1 in a view in the screening direction, FIG. 4 shows a portion of a liner carrier according to the invention in a perspective view.

As can be seen from FIG. 1, a screen 1 according to the invention is alternately provided with crossbars 3 fixed in the screen frame 2 and crossbars 4 movable with respect to said crossbars 3. The crossbars have on their upper sides liner carriers 6 which, according to the invention, are bent up in their lateral end regions 7 (FIG. 2), being bent up by 90° in the exemplary embodiment illustrated. The liner carriers make contact by their outer—the bent-up lower—surfaces with the side walls 5 of the screen frame 2 (also referred to as side cheeks or cheeks) on the inner side of said side walls. The lateral, curved end regions 7 have a very small radius of <150 mm, which in turn ensures a maximum of useful screen width.

In the illustrations, the screen frame 2 and thus the screen liner 9 is illustrated horizontally, but during operation this is generally not the case; rather, the screening direction 11 extends in an oblique direction with respect to the gravitational force (or the horizontal), the screening direction 11 here remaining unchanged with respect to the screen frame 2 and then also extending corresponding obliquely to the surroundings.

FIG. 3 shows, in a direction parallel to the screening direction 11, an end of a liner carrier 6 formed according to the invention in the mounted state: the liner carrier 6 is fastened by its central, rectilinearly extending part to the crossbar 4, and is adjoined by a part 7 bent through 90° whose cross section, indicated by the two obliquely extending edges 12, is designed to be tapered over almost the entire curved region 7 (as shown by the auxiliary figures to FIG. 2) and is formed again with its full cross section and extending rectilinearly in the end region 7' at the point where the profile of the liner carrier 6 has already reached the vertical (to be more precise: the normal direction to the planar screening surface).

In the exemplary embodiment illustrated, the liner carrier 6 has a modular construction and consists of the aforementioned individual parts which are positioned to fit one another and are connected to one another. Of course, the liner carrier can also be formed in one piece. It is also not necessary for the end portion or end region 7' to have once more the cross section of the rectilinear part; it can have a cross section which varies within wide limits.

As also shown in FIG. 3, the end tangents of the liner carriers 6 in this section extend vertically just like the screen frame 2 or the side wall 5, a logical consequence of the curvature through 90°. If a smaller angle of curvature is selected, it is advantageous to bend the side wall 5 in the end region of the liner carriers such that it in turn extends parallel to the end tangent of the liner carrier. In this way, the mechanical stability of the connection is improved and fastening is facilitated.

In addition to the taper, or else instead of it, a different, softer material can be used for the curved region 7 than for the end region 7' and the central, rectilinear part of the liner carrier 6.

The uppermost region 7' of the liner carrier 6 is fastened by two screws 8, illustrated only schematically, to the side wall 5 of the screen frame 2, whereas the lower region, extending horizontally and rectilinearly in the figure, is fastened to the movable crossbar 4, and thus carries out a rotary and/or linear movement with respect to the screen frame 2. The elastic deformations arising as a result of this construction can be withstood by the liner carrier 6 in particular as a result of the reduced cross section and/or softer material in the curved region 7; the screen liner 9, indicated by the innermost three lines, is inherently capable of withstanding these deformations by virtue of its nature as a liner of a flip-flow screen.

In the exemplary embodiment shown, in order to avoid the penetration of impurities and very tiny particles between the side walls 5 of the screen 1 and the liner carrier 6 for the screen liner 9, an additional covering 10 is provided which makes contact with the screen liner 9 or the liner carrier 6 in the uppermost region. Since no relative movements occur here between the screen liner 9 and the liner carrier 6 on the one hand and the screen frame 2 on the other hand, this seal, which is preferably continuous over the entire screen length, is very particularly reliable and tight.

FIG. 4 shows a perspective view of a liner carrier 6 together with its interior in dashed lines. The reduction of the cross section, especially in the screening direction 11, can be clearly seen by means of the bevel behind the lines 12 from which the taper originates.

The screws 13 which are used to fasten the liner carrier 6 in its rectilinear, central portion to the crossbar (irrespective of whether this is a movable or a fixed crossbar) can be clearly seen, as can the reinforcement 14 of metal. In the embodiment of the fastening which is shown, metal is screwed to metal, resulting in a snug non positive connection. As shown in FIG. 1, the screws 13 are accommodated at a protected location within the profile of the crossmembers 3, 4 and thus protected to the greatest extent from corrosion and wear by conveyed material. Adhesion or caking of conveyed material is also thus excluded.

As regards the whole of the described equipment, the crossbars, the liner carriers, the screen liners which extend from crossbar to crossbar and are fixed there with clamping strips 14, all of this can be designed in a modular manner and thus cost-effectively.

For a person skilled in the art of flip-flow screen machines with a knowledge of the invention, it is a simple matter for the inter-related parameters: radius of curvature of the curved parts 7, angle of curvature, formation of the cross section of the curved parts 7 and selection of the material for this region to be tailored appropriately to one another in view of the screen to be designed.

The invention is not limited to the exemplary embodiment which has been illustrated and described, but can be modified in a wide variety of ways. Thus, the liner carriers of the fixed, but also of the movable, crossbars can be designed without the cross section being tapered, the ends 7' can be fastened to the screen frame 2 other than illustrated, the covering 10 can have a different design, and much more. As shown in particular in FIG. 3, a curvature through 90° is advantageous, but not necessary in the final analysis. 80-85° is sufficient in many cases. The cross-sectional taper in the portion 7 is preferably associated with the absence of a reinforcement; the radius of curvature of the curved region 7, which is preferably made as small as possible in order for the effective screening surface, the planar region between the curved regions, to be adversely affected or disturbed as little as possible, or reduced, can be selected to be other than illustrated.

| List of reference signs: | |
|---|---|
| 01 | Screen (machine) |
| 02 | Frame |
| 03 | Fixed crossbar |
| 04 | Movable crossbar |
| 05 | Side cheek |
| 06 | Liner carrier |
| 07 | Curved region |
| 07' | End region |
| 08 | Screws |
| 09 | Screen liner |
| 10 | Covering |
| 11 | Screening direction |
| 12 | Edges |
| 13 | Screws |
| 14 | Clamping strips |

What is claimed is:

1. A flip-flow screen, comprising:

a screen frame having lateral longitudinal walls that define a screening direction;

a plurality of crossmembers mounted to the screen frame and extending transverse to the screening direction, wherein the crossmembers alternate as being either fixedly mounted or movably mounted to the screen frame;

a plurality of liner carriers that are attached to the plurality of crossmembers, each liner carrier having lateral edge regions, end regions, and end faces; wherein the lateral edge regions curve upwardly, at least some liner carriers of the fixed crossmembers are fastened at their end regions to the lateral longitudinal walls of the screen frame, and at least some liner carriers of the movable crossmembers are fastened at their end regions to the lateral longitudinal walls of the screen frame; and a screen liner mounted on the liner carriers.

2. The flip-flow screen according to claim 1, wherein each of the liner carriers of the fixed and movable crossmembers is fastened by their end regions to the lateral longitudinal walls of the screen frame.

3. The flip-flow screen according to claim 1, wherein each of the liner carriers of the fixed and movable crossmembers is screwed by their end regions to the lateral longitudinal walls of the screen frame.

4. The flip-flow screen according to claim 1, wherein the lateral edge regions of the liner carriers have an upward curvature of at least 45°.

5. The flip-flow screen according to claim 1, wherein the lateral edge regions of the liner carriers have an upward curvature of at least 80°.

6. The flip-flow screen according to claim 1, wherein the lateral edge regions of the liner carriers have an upward curvature of about 90°.

7. The flip-flow screen according to claim 1, wherein each of the liner carriers includes a central rectilinear portion disposed between lateral edge portions.

8. The flip-flow screen according to claim 7, wherein those liner carriers that are attached to crossmembers that are movably mounted to the screen frame include in their curved portions a cross section that is tapered relative to their rectilinear portions.

9. The flip-flow screen according to claim 7, wherein those liner carriers that are attached to crossmembers that are movably mounted to the screen frame include a softer material in their curved portions than in their rectilinear portions.

10. The flip-flow screen according to claim 1, further comprising covers that are mounted to the lateral longitudinal walls and that cover both the end faces of the liner carriers and the upper edges of the screen liner.

11. The flip-flow screen according to claim 1, wherein each of the liner carriers is independently formed and includes a metal reinforcement in at least a portion of the liner carrier that is in contact with a crossmember.

12. The flip-flow screen according to claim 11, wherein each of the liner carriers is attached to its respective crossmember in a metal-on-metal fashion by one or more screws.

13. The flip-flow screen according to claim 12, wherein each crossmember has a profile that includes at least one inner cavity, and the screws are provided in the inner cavity.

14. The flip-flow screen according to claim 1, wherein a radius of the curved portion of each liner carrier is at most 150 mm.

15. The flip-flow screen according to claim 1, wherein in a region where the liner carriers connect to the lateral longitudinal walls of the screen frame, each lateral longitudinal wall extends in a plane that lies at least substantially parallel to an end tangent of each liner carrier.

* * * * *